US010094145B1

(12) United States Patent
Wan

(10) Patent No.: US 10,094,145 B1
(45) Date of Patent: Oct. 9, 2018

(54) SENSING MODULE

(71) Applicant: Vision Automobile Electronics Industrial Co., Ltd., Tainan (TW)

(72) Inventor: Tien-Bou Wan, Tainan (TW)

(73) Assignee: Vision Automobile Electronics Industrial Co., Ltd., Tainan (TW)

( * ) Notice: Subject to any disclaimer, the term of this patent is extended or adjusted under 35 U.S.C. 154(b) by 0 days.

(21) Appl. No.: 15/879,404

(22) Filed: Jan. 24, 2018

(30) Foreign Application Priority Data

Sep. 4, 2017 (TW) ..... 106213088 U

(51) Int. Cl.
*E05B 47/00* (2006.01)
*E05B 17/22* (2006.01)
*E05B 73/00* (2006.01)

(52) U.S. Cl.
CPC ..... *E05B 47/004* (2013.01); *E05B 17/22* (2013.01); *E05B 73/0052* (2013.01); *E05B 2047/0068* (2013.01); *E05B 2047/0069* (2013.01); *E05B 2047/0092* (2013.01)

(58) Field of Classification Search
CPC ..... E05B 17/22; E05B 2047/0068; E05B 2047/0069; E05B 2047/0092; E05B 47/004; E05B 73/0052; E06B 7/28
See application file for complete search history.

(56) References Cited

U.S. PATENT DOCUMENTS

2007/0118312 A1* 5/2007 Cech ..... B60R 21/0136 702/65
2009/0146846 A1* 6/2009 Grossman ..... B60R 25/04 340/988
2012/0167646 A1* 7/2012 Sharma ..... G01B 7/31 70/280
2013/0252552 A1* 9/2013 Vitkus ..... H04Q 9/00 455/41.2
2015/0330140 A1* 11/2015 Kincaid ..... E06B 7/28 324/207.12
2016/0040460 A1* 2/2016 Kasai ..... E05B 47/0001 292/251.5
2016/0306062 A1* 10/2016 Keene ..... G01R 33/288

* cited by examiner

*Primary Examiner* — Thomas Alunkal
(74) *Attorney, Agent, or Firm* — DLA Piper LLP (US)

(57) ABSTRACT

A sensing module for sensing a position of a door panel includes a sensing unit, a processing unit, and a radio frequency transceiving unit. The sensing unit is disposed in a cavity for receiving a bolt of the door panel, detects a variation in magnetic field attributed to the bolt, and outputs a sensing signal indicating the variation in magnetic field detected thereby. The processing unit is electrically connected to the sensing unit to receive the sensing signal from the sensing unit, determines whether the position of the door panel is an open position or a closed position based on the variation in magnetic field and predetermined magnetic field information, and generates an informing signal indicating the position of the door panel.

11 Claims, 3 Drawing Sheets

SENSING MODULE

CROSS-REFERENCE TO RELATED APPLICATION

This application claims priority to Taiwanese Patent Application No. 106213088 filed on Sep. 4, 2017.

FIELD

The disclosure relates to a sensing module, more particularly to a sensing module for sensing a position of a door panel.

BACKGROUND

A conventional sensing module for sensing a position of a door panel or a window generally includes a magnet, and a sensing unit for detecting a strength of magnetic field generated by the magnet. One of the magnet and the sensing unit is mounted to a moveable component (i.e., the door panel or the window), and the other one of the magnet and the sensing unit is mounted to a fixed component (i.e., a door frame or a window frame). In installing the magnet and the sensing unit, the position of the magnet and the sensing unit must be aligned with each other when the door panel (or the window) is closed. The sensing unit outputs a sensing signal indicating the detected strength of magnetic field to a backend device, so that the backend device is able to indicate the door panel (or the window) being in an open state or a closed state based on the detected strength of magnetic field.

However, installation of such sensing module and the magnet is troublesome since it is required to align the magnet and the sensing unit carefully. Further, since the sensing module and the magnet are usually mounted to the exterior of the door panel (or the window) and the door frame (or the window frame) and are clearly visible, a thief may install another magnet to be sensed by the sensing unit to trick the sensing unit into outputting the sensing signal that indicates that the door panel or the window is still in the closed state when the door panel or the window is in fact being opened by the thief.

SUMMARY

Therefore, an object of the disclosure is to provide a sensing module for alleviating the above drawbacks of the conventional sensing module.

According to the disclosure, a sensing module for sensing a position of a door panel is provided. The door panel includes a lock having a bolt and is mounted to a door frame formed with a cavity for receiving the bolt.

The sensing module includes an antenna, a sensing unit, a processing unit, a radio frequency transceiving unit and a filtering unit. The sensing unit is configured to be disposed in the cavity, and is to be activated to detect a variation in magnetic field attributed to the bolt and to output a first sensing signal (S1) indicating the variation in magnetic field detected thereby.

The processing unit is electrically connected to the sensing unit, and is configured to periodically output an enablement signal to the sensing unit so as to activate the sensing unit, to receive the first sensing signal from the sensing unit, to determine whether the position of the door panel is an open position or a closed position based on the variation in magnetic field indicated by the first sensing signal and on predetermined magnetic field information, and to generate a first informing signal indicating the position of the door panel thus determined.

The radio frequency transceiving unit is electrically connected to the processing unit for receiving the first informing signal, and is configured to, upon receipt of the first informing signal, output a first radio frequency signal according to the first informing signal.

The filtering unit is electrically connected between the antenna and the radio frequency transceiving unit, and is configured to receive the first radio frequency signal, and to, upon receipt of the first radio frequency signal, filter the first radio frequency signal to obtain a first filtered output signal to be output through the antenna as a first radio frequency output signal.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
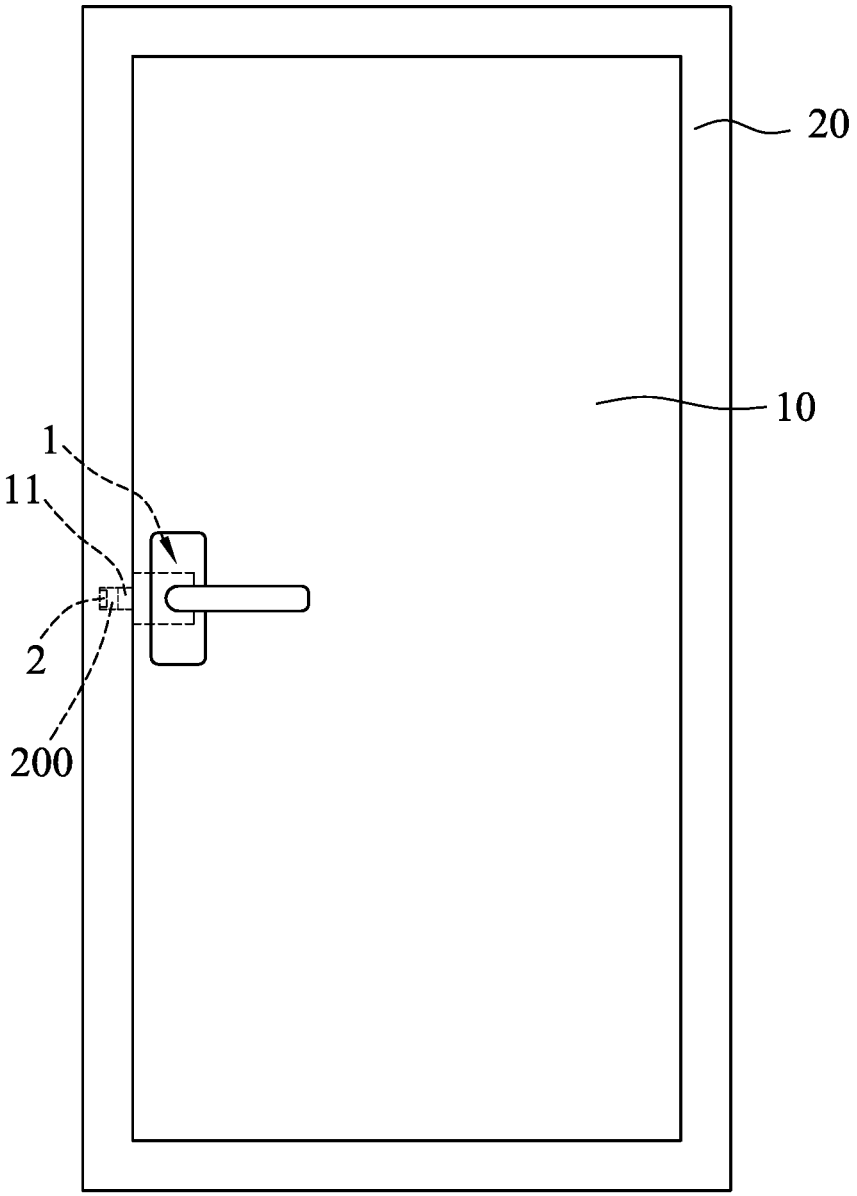
FIG. 1 is schematic view of a door panel mounted with a sensing module according to one embodiment of this disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
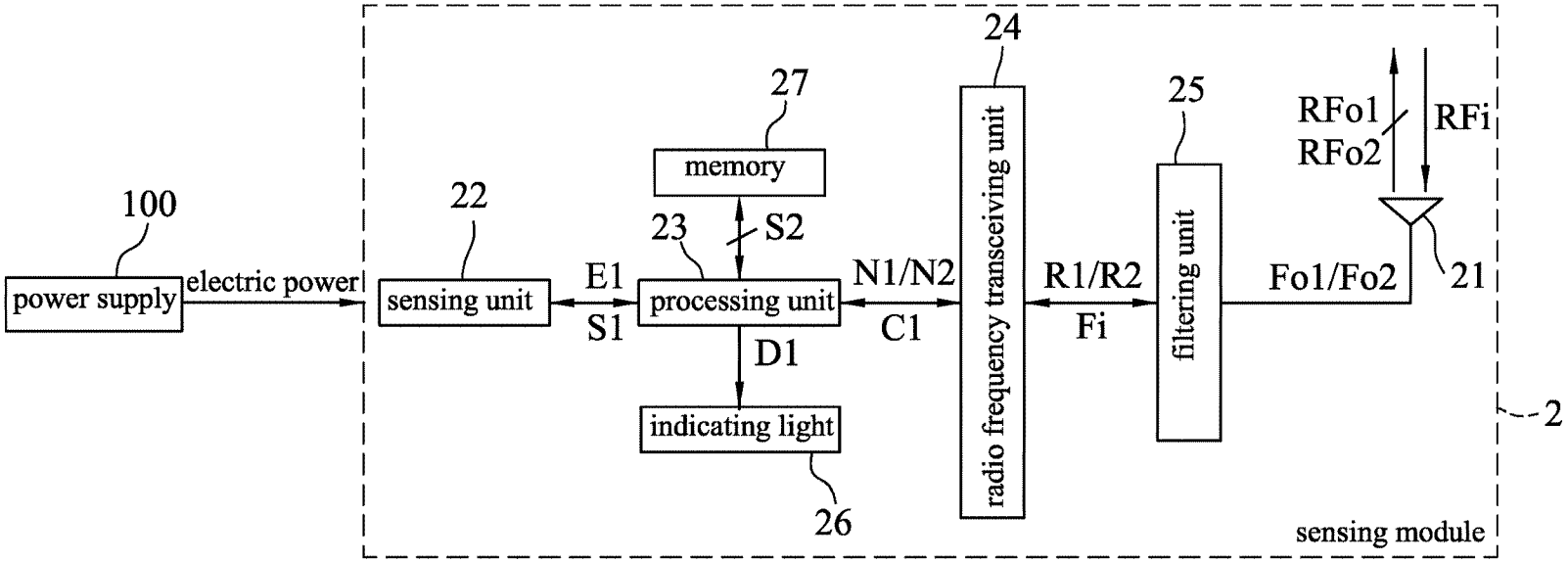
FIG. 2 is a block diagram of the sensing module according to one embodiment of this disclosure.

Referring to FIGS. 1 and 2, a sensing module 2 for sensing a position of a door panel 10 according to one embodiment of the present disclosure is illustrated.

The door panel 10 includes a lock 1 having a bolt 11 (e.g., a latch bolt, a spring bolt, etc.), and is mounted to a door frame 20 formed with a cavity 200 for receiving the bolt 11. The door panel 10 is movable between an open position, and a closed position. For a latch bolt, when the door panel 10 is in the open position, the bolt 11 is away from the cavity 200, and when the door panel 10 is in the closed position, the bolt 11 is received in the cavity 200.

The sensing module 2 is an integrated module, and is disposed in the cavity 200 in a manner that the sensing module 2 is spaced apart from and faces the bolt 11 when the door panel 10 is at the closed position. The sensing module 2 receives electricity from a power source 100 (e.g., a button cell), and includes an antenna 21, a sensing unit 22, a processing unit 23, a radio frequency (RF) transceiving unit 24, a filtering unit 25, an indicating light 26 and a memory 27. The sensing module 2 may operate in one of a first mode and a second mode. The sensing module 2 is preset to usually operate in the first mode, where the sensing module 2 periodically determines whether the position of the door panel 10 is the open position or the closed position by detecting a position of the bolt 11 and outputs a first RF output signal (RFo1) to indicate the determined position of the door panel 10.

When the sensing module 2 receives an RF input signal (RFi), the sensing module 2 is switched to operate in the second mode and then outputs a second RF output signal (RFo2) indicating the latest determined position of the door panel 10. For example, the RF input signal (RFi) may be received from a remote device, e.g., a smartphone, operated by a user who intends to know the position of the door panel 10.

The antenna 21 is for receiving the radio frequency input signal (RFi) and outputting the first and second radio frequency output signal (RFo1, RFo2).

The sensing unit 22 is to be activated to detect variation in magnetic field (i.e., terrestrial magnetism (Earth's magnetic field)) attributed to the bolt 11, and to output a first sensing signal (S1) indicating the variation in magnetic field detected thereby. In this embodiment, the sensing unit 22 is a magnetometer.

The processing unit 23 is electrically connected to the sensing unit 22, and is configured to periodically output (e.g., every 0.3 seconds) an enablement signal (E1) to the sensing unit 22 so as to activate the sensing unit 22 to output the first sensing signal (S1) periodically when the sensing module 2 is in the first mode. The processing unit 23 is further to receive the first sensing signal (S1) from the sensing unit 22, to determine whether the position of the door panel 10 is the open position or the closed position based on the variation in magnetic field indicated by the first sensing signal (S1) and on predetermined magnetic field information, and to generate a first informing signal (N1) indicating the position of the door panel 10 thus determined.

In this embodiment, the predetermined magnetic field information includes a first magnetic range (e.g., 1 gauss (G) to 5G) related to the open position of the door panel 10, and a second magnetic range (e.g., 6G to 10G) related to the closed position of the door panel 10. It should be noted that the first magnetic range and the second magnetic range depend on the material, size, shape, etc. of the bolt 11, and may be different in other embodiments. The processing unit 23 generates the first informing signal (N1) indicating the open position when the variation in magnetic field indicated by the first sensing signal (S1) falls within the first magnetic range, and generates the first informing signal (N1) indicating the closed position when the variation in magnetic field indicated by the first sensing signal (S1) falls within the second magnetic range.

In some embodiments, when the processing unit 23 receives the first sensing signal (S1) for the first time, the processing unit 23 generates the first informing signal (N1) indicating the position of the door panel 10 according to which one of the first and second magnetic ranges the variation in magnetic field indicated by the first sensing signal (S1) falls within. After the first informing signal (N1) is outputted by the processing unit 23 for the first time, the processing unit 23 generates the first informing signal (N1) based on the predetermined magnetic field information and the first sensing signal (S1) that is currently received when one and the other of the variation in magnetic field indicated by the first sensing signal (S1) currently received by the processing unit 23 and the variation in magnetic field indicated by the first sensing signal (S1) previously received by the processing unit 23 respectively fall within the first and second magnetic ranges. That is to say, after the first informing signal (N1) is outputted by the processing unit 23 for the first time, the processing unit 23 outputs the first informing signal (N1) again only when the position of the door panel 10 changes from one of the open and closed positions to the other one of the open and closed positions.

The RF transceiving unit 24 is electrically connected to the processing unit 23 for receiving the first informing signal (N1), and is configured to, upon receipt of the first informing signal (N1), output a first RF signal (R1) according to the first informing signal (N1). For example, the RF transceiving unit 24 decodes the first informing signal (N1) to obtain data included in the first informing signal (N1), and then generates the first RF signal (R1) to include the data therein. The filtering unit 25 is electrically connected between the antenna 21 and the RF transceiving unit 24, and is configured to receive the first RF signal (R1), and to filter the first RF signal (R1) to obtain a first filtered output signal (Fo1) to be output through the antenna (21) as a first RF output signal (RFo1) upon receipt of the first RF signal (R1).

The indicating light 26 is electrically connected to the processing unit 23, and the processing unit 23 is further configured to transmit a driving signal (D1) to the indicating light 26 according to the first sensing signal (S1) received thereby for driving the indicating light 26 to emit light. For example, when the variation in magnetic field indicated by the first sensing signal (S1) falls in the first magnetic range (i.e., the door panel 10 is at the open position), the driving signal (D1) generated by the processing unit 23 drives the indicating light 26 to emit red light. On the other hand, when the variation in magnetic field indicated by the first sensing signal (S1) falls in the second magnetic range (i.e., the door panel 10 is at the closed position), the driving signal (D1) generated by the processing unit 23 drives the indicating light 26 to emit green light. In other embodiments, the indicating light 26 is controlled by the processing unit 23 to flash at all times; when the door panel 10 is at the open position, the flashing light would be visible by a user, and when the door panel 10 is at the closed position, the flashing light would be blocked from view by the door panel 10.

The memory 27 is electrically connected to the processing unit 23. The processing unit 23 is further configured to store, in the memory 27, data of the variation in magnetic field included in the first sensing signal (S1).

When the sensing module 2 receives the RF input signal (RFi) via the antenna 21 and operates in the second mode accordingly, the filtering unit 25 filters the RF input signal (RFi) to obtain a filtered input signal (Fi). Then, the RF transceiving unit 24 generates a control signal (C1) according to the filtered input signal (Fi) received from the filtering unit 25, and transmits the control signal (C1) to the processing unit 23. Upon receipt of the control signal (C1), the processing unit 23 reads the data of the variation in magnetic field stored in the memory 27, and generates a second informing signal (N2) indicating the position of the door panel 10 based on the data of the variation in magnetic field read from the memory 27 and the predetermined magnetic field information. The RF transceiving unit 24 outputs a second radio frequency signal (R2) including data obtained from the second informing signal (N2) upon receipt of the second informing signal (N2). The filtering unit 25 further filters the second RF signal (R2) received from the RF transceiving unit 24 to obtain a second filtered output signal (Fo2) to be output through the antenna 21 as the second RF output signal (RFo2). By this way, the user who intends to know the current position of the door panel 10 can be notified of the same upon receipt of the second RF output signal (RFo2) by the remote device.

Figure 3:
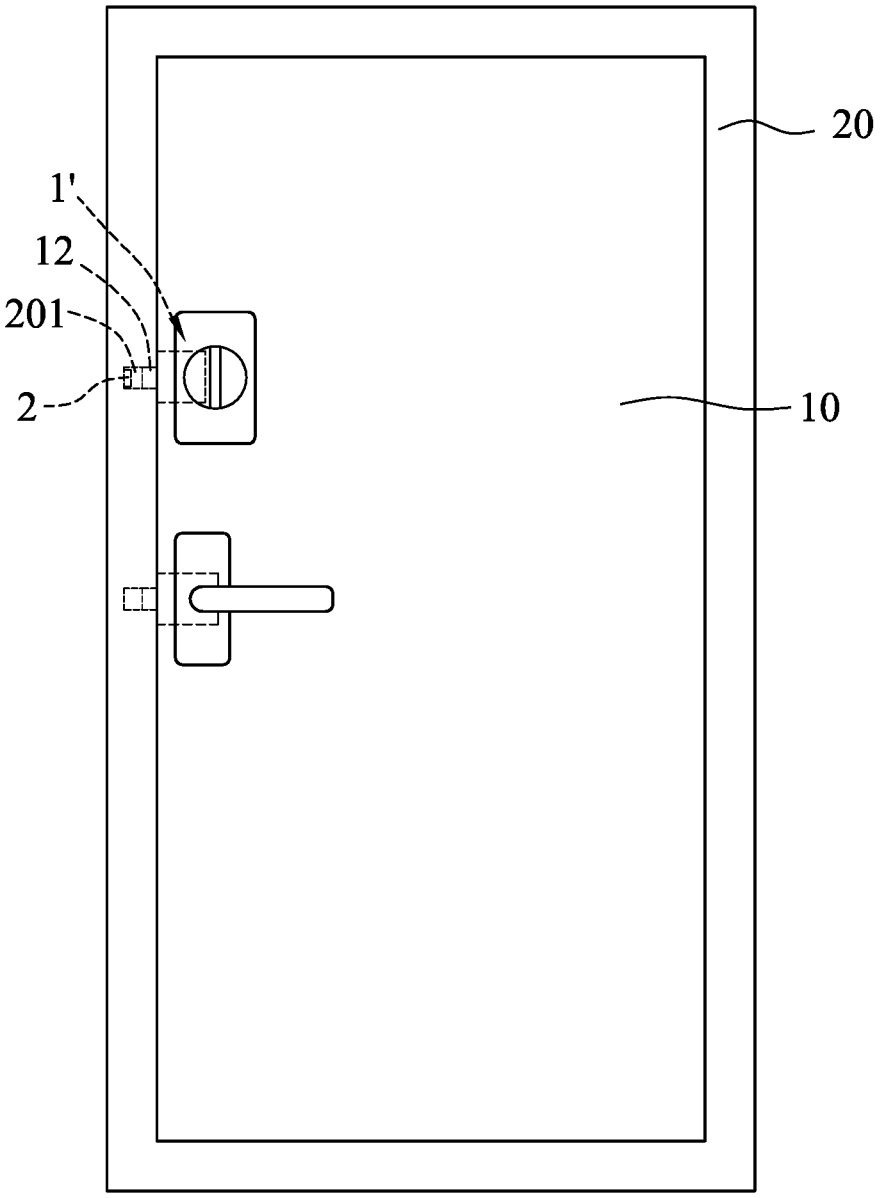
FIG. 3 is another schematic view of the door panel mounted with a sensing module according to another embodiment of this disclosure.

Referring to FIGS. 2 and 3, the sensing module 2 according to another embodiment of this disclosure is shown. This embodiment is similar to the embodiment shown in FIG. 1, and the differences therebetween are to be described in the following. In this embodiment, the door panel 10 further includes another lock 1' having a bolt 12 (e.g., a dead bolt) for locking the door panel 10 to the door frame 20, and the sensing module 2 is mounted in a cavity 201 that is formed in the door frame 20 and that is for receiving the bolt 12 therein. The bolt 12 is switchable between an unlocked position where the bolt 12 is not received in the cavity 201, and a locked position where the bolt 12 is received in the cavity 201. The sensing unit 22 is to be activated to detect a variation in magnetic field attributed to the bolt 12. In this embodiment, the predetermined magnetic field information includes: a first magnetic range (e.g., 1G to 5G) related to the open position of the door panel 10 where the bolt 12 is further away from the cavity 201 as compared to when the door panel 10 is in the closed position regardless of whether the bolt 12 is in the unlocked or locked position; a second magnetic range (e.g., 11G to 13G) related to the closed position of the door panel 10 and the unlocked position of the bolt 12; and a third magnetic range (e.g., 14G to 16G) related to the closed position of the door panel 10 and the locked position of the bolt 12. Similarly, the first, second and third magnetic ranges depend on the material, size, shape, etc. of the bolt 12, and may be different in other embodiments.

In this embodiment, when the sensing module 2 operates in the first mode and the processing unit 23 receives the first sensing signal (S1) for the first time, the processing unit 23 generates the first informing signal (N1) indicating that the door panel 10 is at the open position when the variation in magnetic field indicated by the first sensing signal (S1) falls within the first magnetic range, generates the first informing signal (N1) indicating that the door panel 10 is at the closed position and the bolt 11 is at the unlocked position when the variation in magnetic field indicated by the first sensing signal (S1) falls within the second magnetic range, and generates the first informing signal (N1) indicating that the door panel 10 is at the closed position and the bolt 12 is at the locked position when the variation in magnetic field indicated by the first sensing signal (S1) falls within the third magnetic range.

After the first informing signal (N1) is outputted by the processing unit 23 for the first time, the processing unit 23 generates another first informing signal (N1) indicating the position of the door panel 10 and the position of the bolt 12 based on the predetermined magnetic field information and the first sensing signal (S1) that is newly received when the variation in magnetic field indicated by the first sensing signal (S1) newly received by the processing unit 23 and the variation in magnetic field indicated by the first sensing signal (S1) previously received by the processing unit 23 fall within different ones of the first, second and third magnetic ranges. In this embodiment, the processing unit 23 outputs the first informing signal (N1) only when either the position of the door panel 10 changes or the position of the bolt 12 changes after the first informing signal (N1) is outputted by the processing unit for the first time.

The operations of other components of this embodiment are similar to those of the embodiment of FIG. 1, and thus details thereof are omitted herein for the sake of brevity.

To sum up, by virtue of the sensing unit 22 that detects the variation in magnetic field attributed to the bolt 11 or 12, and outputs the first sensing signal (S1) to thereby enable the processing unit 23 to generate the first informing signal (N1) or the second informing signal (N2) to indicate the position of the door panel 10 (and the position of the bolt 12), a magnet mentioned in the conventional sensing module is not required and the cost for the sensing module 2 can be reduced. Further, since the sensing module 2 is directly mounted in the cavity 200 or 201 in the door frame 20 (or a window frame or the like in other embodiments), installation of the sensing module 2 is relatively simple and does not require careful alignment of the sensing module 2 with another component, and a relatively neat appearance of the door panel 10 and the door frame 20 can be maintained. Additionally, a thief is unable to know the exact position of the sensing module 2 and thus cannot devise a scheme to trick the sensing unit 22.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A sensing module for sensing a position of a door panel that includes a lock having a bolt and that is mounted to a door frame formed with a cavity for receiving the bolt, said sensing module comprising:

an antenna;

a sensing unit configured to be disposed in the cavity, and to be activated to detect a variation in magnetic field attributed to the bolt and to output a first sensing signal indicating the variation in magnetic field detected thereby;

a processing unit electrically connected to said sensing unit, and configured to periodically output an enablement signal to said sensing unit so as to activate said sensing unit, to receive the first sensing signal from said sensing unit, to determine whether the position of the door panel is an open position or a closed position based on the variation in magnetic field indicated by the first sensing signal and on predetermined magnetic field information, and to generate a first informing signal indicating the position of the door panel determined by said processing unit;

a radio frequency transceiving unit electrically connected to said processing unit for receiving the first informing signal, and configured to, upon receipt of the first informing signal, output a first radio frequency signal according to the first informing signal; and a filtering unit electrically connected between said antenna and said radio frequency transceiving unit, and configured to receive the first radio frequency signal, and to, upon receipt of the first radio frequency signal, filter the first radio frequency signal to obtain a first filtered output signal to be output through said antenna as a first radio frequency output signal.

2. The sensing module as claimed in claim 1, the bolt being away from the cavity when the door panel is at the open position, and being received in the cavity when the door panel is at the closed position, wherein:

the predetermined magnetic field information includes a first magnetic range related to the open position of the door panel, and a second magnetic range related to the closed position of the door panel; and said processing unit generates the first informing signal indicating the open position when the variation in magnetic field indicated by the first sensing signal falls within the first magnetic range, and generates the first informing signal indicating the closed position when the variation in magnetic field indicated by the first sensing signal falls within the second magnetic range.

3. The sensing module as claimed in claim 2, wherein said processing unit generates the first informing signal indicating the position of the door panel based on the predetermined magnetic field information and the first sensing signal that is currently received when one and the other of the variation in magnetic field indicated by the first sensing signal currently received by said processing unit and the variation in magnetic field indicated by the first sensing signal previously received by said processing unit respectively fall within the first and second magnetic ranges.

4. The sensing module as claimed in claim 1, wherein:

the predetermined magnetic field information includes a first magnetic range related to the open position of the door panel, a second magnetic range related to the closed position of the door panel and an unlocked position of the bolt where the bolt is not received in the cavity, and a third magnetic range related to the closed position of the door panel and a locked position of the bolt where the bolt is received in the cavity; and said processing unit generates the first informing signal indicating that the door panel is at the open position when the variation in magnetic field indicated by the first sensing signal falls within the first magnetic range, generates the first informing signal indicating that the door panel is at the closed position and the bolt is at the unlocked position when the variation in magnetic field indicated by the first sensing signal falls within the second magnetic range, and generates the first informing signal indicating that the door panel is at the closed position and said bolt is at the locked position when the variation in magnetic field indicated by the first sensing signal falls within the third magnetic range.

5. The sensing module as claimed in claim 4, wherein said processing unit generates the first informing signal indicating the position of the door panel based on the predetermined magnetic field information and the first sensing signal that is currently received when the variation in magnetic field indicated by the first sensing signal currently received by said processing unit and the variation in magnetic field indicated by the first sensing signal previously received by said processing unit fall within different ones of the first, second and third magnetic ranges.

6. The sensing module as claimed in claim 1, further comprising an indicating light electrically connected to said processing unit, wherein said processing unit is further configured to transmit a driving signal to said indicating light according to the first sensing signal received thereby for driving said indicating light to emit light.

7. The sensing module as claimed in claim 1, further comprising an indicating light electrically connected to said processing unit and controlled by said processing unit to flash.

8. The sensing module as claimed in claim 1, further comprising a memory electrically connected to said processing unit, wherein said processing unit is further configured to store, in said memory, data of the variation in magnetic field included in the first sensing signal.

9. The sensing module as claimed in claim 8, wherein:

said filtering unit is further configured to filter a radio frequency input signal received from said antenna to obtain a filtered input signal;

said radio frequency transceiving unit is further configured to generate a control signal according to the filtered input signal received from said filtering unit, and to transmit the control signal to said processing unit;

upon receipt of the control signal, said processing unit reads the data of the variation in magnetic field stored in said memory and generates a second informing signal indicating the position of the door panel based on the data of the variation in magnetic field stored in said memory and the predetermined magnetic field information;

said radio frequency transceiving unit is configured to output, upon receipt of the second informing signal, a second radio frequency signal including the second informing signal; and said filtering unit is further configured to receive the second radio frequency signal and to filter the second radio frequency signal to obtain a second filtered output signal to be output through said antenna as a second radio frequency output signal.

10. The sensing module as claimed in claim 9, the bolt being away from the cavity when the door panel is at the open position, and being received in the cavity when the door panel is at the closed position, wherein:

the predetermined magnetic field information includes a first magnetic range related to the open position of the door panel, and a second magnetic range related to the closed position of the door panel; and said processing unit generates a second informing signal indicating the open position when the variation in magnetic field indicated by the first sensing signal falls within the first magnetic range, and generates the second informing signal indicating the closed position when the variation in magnetic field indicated by the first sensing signal falls within the second magnetic range.

11. The sensing module as claimed in claim 9, wherein:

the predetermined magnetic field information includes a first magnetic range related to the open position of the door panel, a second magnetic range related to the closed position of the door panel and an unlocked position of the bolt where the bolt is not received in the cavity, and a third magnetic range related to the closed position of the door panel and a locked position of the bolt where the bolt is received in the cavity; and said processing unit generates a second informing signal indicating that the door panel is at the open position when the variation in magnetic field indicated by the first sensing signal falls within the first magnetic range, generates the second informing signal indicating that the door panel is at the closed position and the bolt is at the unlocked position when the variation in magnetic field indicated by the first sensing signal falls within the second magnetic range, and generates the second informing signal indicating that the door panel is at the closed position and said bolt is at the locked position when the variation in magnetic field indicated by the first sensing signal falls within the third magnetic range.

* * * * *